US010240552B2

(12) United States Patent
Sekita

(10) Patent No.: US 10,240,552 B2
(45) Date of Patent: Mar. 26, 2019

(54) FUEL INJECTION SYSTEM FOR ENGINE

(71) Applicant: MAHLE ELECTRIC DRIVES JAPAN CORPORATION, Shizuoka-ken (JP)

(72) Inventor: Tomoaki Sekita, Nagaizumi-Cho (JP)

(73) Assignee: MAHLE ELECTRIC DRIVES JAPAN CORPORATION, Shizuoka-Ken (JP)

( * ) Notice: Subject to any disclaimer, the term of this patent is extended or adjusted under 35 U.S.C. 154(b) by 0 days.

(21) Appl. No.: 15/711,617

(22) Filed: Sep. 21, 2017

(65) Prior Publication Data

US 2018/0087464 A1 Mar. 29, 2018

Related U.S. Application Data

(60) Provisional application No. 62/399,728, filed on Sep. 26, 2016.

(51) Int. Cl.

| | |
|---|---|
| ***F02D 41/00*** | (2006.01) |
| ***F02D 41/30*** | (2006.01) |
| ***F02D 41/06*** | (2006.01) |
| ***F02N 3/00*** | (2006.01) |
| ***F02N 3/02*** | (2006.01) |
| ***F02N 11/08*** | (2006.01) |
| *F02D 41/12* | (2006.01) |

(52) U.S. Cl.

CPC ..... *F02D 41/3076* (2013.01); *F02D 41/009* (2013.01); *F02D 41/062* (2013.01); *F02D 41/3082* (2013.01); *F02N 3/00* (2013.01); *F02N 3/02* (2013.01); *F02N 11/0862* (2013.01); *F02D 41/123* (2013.01); *F02D 2041/0092* (2013.01); *F02D 2200/021* (2013.01); *F02D 2200/0602* (2013.01)

(58) Field of Classification Search

CPC .. F02D 41/3076; F02D 41/009; F02D 41/062; F02D 41/3082; F02D 41/123; F02D 2041/0092; F02D 2200/021; F02D 2200/0602; F02N 3/00; F02N 3/02; F02N 11/0862

See application file for complete search history.

(56) References Cited

U.S. PATENT DOCUMENTS 5,216,994 A * 6/1993 Aoki ..... F02D 41/062 123/149 R
5,809,973 A * 9/1998 Iida ..... F02D 41/0087 123/179.16

(Continued)

FOREIGN PATENT DOCUMENTS

| | | |
|---|---|---|
| JP | 2002089390 | 3/2002 |
| JP | 2005-330815 | 12/2005 |

*Primary Examiner* — Thomas Moulis
(74) *Attorney, Agent, or Firm* — Pearne & Gordon LLP

(57) ABSTRACT

A battery-less fuel injection system, provided with an injector for injecting fuel supplied to an engine, a fuel pump for supplying fuel to the injector, and an ECU for controlling the injector, wherein a fuel pressure sensor for detecting the fuel pressure given to the injector is provided, and the ECU controls the fuel injection in the process of starting the engine, so that execution of fuel injection is suspended when the fuel pressure detected by the fuel pressure sensor is a set pressure or less, until it is confirmed that the detected fuel pressure has exceeded the set pressure.

8 Claims, 12 Drawing Sheets

(56) References Cited

U.S. PATENT DOCUMENTS 5,979,400 A * 11/1999 Nishide ..... F02D 35/023 123/294
6,138,638 A * 10/2000 Morikawa ..... F02D 41/061 123/295
2002/0038652 A1* 4/2002 Uemura ..... F02D 41/0087 123/480
2004/0050368 A1* 3/2004 Kitagawa ..... F02D 41/064 123/480
2006/0225695 A1* 10/2006 Fukasawa ..... F02D 41/062 123/305
2007/0028898 A1* 2/2007 Namari ..... F02D 41/062 123/491
2008/0154484 A1* 6/2008 Takeyama ..... F02D 41/065 701/113
2008/0294327 A1* 11/2008 Oono ..... F02D 41/221 701/104
2009/0020092 A1* 1/2009 Kishibata ..... F02D 41/062 123/179.3
2009/0063014 A1* 3/2009 Tokugawa ..... F02D 37/02 701/103
2009/0063015 A1* 3/2009 Tokugawa ..... F02D 41/009 701/103
2010/0071661 A1* 3/2010 Joos ..... F02D 19/0605 123/435
2011/0073077 A1* 3/2011 Yamaguchi ..... F02D 41/0042 123/491
2012/0022740 A1* 1/2012 Ohsaki ..... F02D 41/0235 701/33.9
2014/0222316 A1* 8/2014 Murai ..... F02D 41/064 701/104
2014/0299103 A1* 10/2014 Yanoto ..... F02D 41/064 123/447
2017/0356382 A1* 12/2017 McQuillen ..... F02M 55/025

* cited by examiner

Sp
P
S5
P'
S6
P
S1
S2
S3
S4
S5

Vs
Vs5
Vs6
Vs1
Vs2
Vs3
Vs4
Vs5

Pf
Pfs
Pf

Vj1
OFF
ON

Vj2
OFF
ON

Vj3
OFF
ON
t0
t1
t2
t3
t4
t5
t6
t7
t8
t9
t[sec]
CPU ACTIVATED

FUEL INJECTION SYSTEM FOR ENGINE

TECHNICAL FIELD

The present invention relates to a fuel injection system for an engine that, without using a battery, operates a fuel pump, an injector, and an ECU for injector control using the output of a generator driven by the engine, to perform injection of fuel to the engine.

BACKGROUND ART

When serious consideration is given to structural simplification, weight reduction, or cost reduction of a device driven by an engine, a fuel injection system, ignition system, etc., is operated without a battery using a generator driven by the engine as the power supply. In the present specification, a fuel injection system operated without a battery and using a generator driven by the engine as the power supply is called a battery-less fuel injection system. This type of fuel injection system is disclosed in Japanese Laid-Open Patent Application No. 2005-330815 and Japanese Laid-Open Patent Application No. 2002-89390.

To have an engine to which fuel is supplied by a fuel injection system perform a desired operation, it is necessary to control the fuel injection timing and the fuel injection amount, and control the ignition timing of the engine. Normally, these controls are performed by an electronic control unit (ECU) provided with a CPU for executing software needed for control, and with circuits for driving the fuel injection system and/or the ignition system according to commands given from the CPU.

The voltage outputted by the generator attached to the engine is converted to power supply voltage (e.g., 5V) given to the ECU, and power supply voltage (e.g., 12V), given to the fuel pump and the injector by a power supply circuit provided with a rectifier circuit, and with a control circuit for controlling the output of the rectifier circuit to a fixed value or less.

An engine for driving a vehicle, etc., without a battery mounted is started by a manually operated starting device such as a recoil starter or a kick starter. When the engine starting operation is performed, the generator generates voltage, and power supply voltage is given to the fuel pump and the ECU through a predetermined power supply circuit from the generator. When the output voltage of the generator reaches the voltage at which the ECU can operate, the ECU microprocessor is activated.

Because power supply voltage is also given to the fuel pump in such instances, the fuel pump starts operating, and the fuel inside the fuel tank is supplied to the injector. After a reset operation of the ECU is completed, the ECU gives an injection command pulse to an injector drive circuit and has the injector perform the injection operation when it has been detected that a crank angle sensor attached to the engine has generated a crank angle signal at a set reference rotation angle position.

When the engine is started to which fuel is supplied by a battery-less fuel injection system, the initial explosion of the engine after the start of the starting operation is thus performed as early as possible, and to make it easy to start the engine, the ECU has the injector perform the injection operation when the crank angle signal generated by the crank angle sensor is detected, without waiting for the regular fuel injection timing to be detected. When the engine has two or more cylinders, and an injector is provided for each cylinder, the injection operation is performed simultaneously for all the injectors when the crank angle signal is detected, in order to have the initial explosion performed as early as possible by one of the cylinders after the starting operation starts.

The ECU also controls the ignition system for igniting the engine, and has the ignition system perform the ignition operation at a predetermined rotation angle position. When the ignition operation is performed on a cylinder of an engine to which fuel injected from an injector has been supplied, the first combustion (initial explosion) is performed at that cylinder, and the engine is started.

To have combustion performed within a given cylinder of the engine when the cylinder is ignited, it is necessary to have injected sufficient fuel to inside the intake pipe, or inside the cylinder, etc., in an amount necessary for the air-fuel ratio of the air fuel mixture that exists inside that cylinder at the time of ignition to be a value within a range over which combustion is possible. The amount of fuel injected from the injector is determined by the product of the pressure of the fuel given from the fuel pump to the injector (fuel pressure), and the time the injector valve is open (valve opening time or fuel injection time). Therefore, after starting of the starting operation, until the first fuel injection is performed, it is necessary to raise the fuel pressure given to the injector to a predetermined pressure to have the engine started reliably.

In the battery-less fuel injection system, within the small amount of time in which starting operation is performed to start the engine, it is necessary to drive the fuel pump with output of the generator driven by the engine, and increase the fuel pressure given to the injector to a predetermined pressure. When the fuel injection operation is performed by the injector in a state with insufficient fuel pressure, it is not possible to inject sufficiently atomized fuel from the injector, so fuel of a large particle diameter is injected inside the engine intake pipe or inside the cylinder (combustion chamber interior). When large particle diameter fuel is injected, it is difficult for the fuel to be sufficiently vaporized; therefore, it is no longer possible to obtain an air fuel mixture of the predetermined air-fuel ratio, and engine startability significantly decreases. Especially when the engine is started at low temperatures, due to a decrease in the viscosity of the engine lubricating oil, there is a marked increase in the burden on the driver for starting operation, and since the crankshaft cannot rotate with sufficient speed, it is difficult to raise the generator output voltage by the starting operation, and such problems become more prominent. In the worst case, due to the inflow of fuel inside the cylinder without sufficient vaporization, there are cases when the periphery of the spark plug discharge electrode becomes wet, and no sparking will occur, making it impossible to start the engine despite repeating the starting operation many times.

In a battery-less fuel injection system, in order to prevent the occurrence of a situation with insufficient fuel pressure when the engine is started, with the invention noted in Japanese Laid-Open Patent Application No. 2005-330815, a mechanically driven fuel pump to supply the fuel inside the fuel tank to the injector is provided in addition to an electric fuel pump driven by the output of the generator. The mechanical driving force for driving the mechanically driven fuel pump is given from the starting device, and the fuel pressure given to the injector is increased by driving the mechanically driven fuel pump during starting operation.

Also, Japanese Laid-Open Patent Application No. 2002-89390 discloses an invention with which a fuel pressurization device is inserted midway in a fuel supply passage that reaches from the fuel pump to the injector, and insufficient fuel pressure during starting is prevented by using this pressurization device to raise the pressure of the fuel given to the injector. There are disclosed, as fuel pressurization devices, a device that operates in conjunction with the recoil starter to increase the fuel pressure, and a device that increases the fuel pressure in advance by manual pulling of an operation knob before starting the engine starting operation.

According to the invention noted in Japanese Laid-Open Patent Application No. 2005-330815, when the engine is started, it is necessary to drive the mechanically driven fuel pump simultaneously with driving the kick starter or the recoil starter, so there is a greater burden on the driver, and the problem of difficulty in increasing the rotating speed of the crankshaft arises. If the crankshaft cannot be rotated at sufficient speed, there can be no great expectation of an effect in terms of increasing the fuel pressure, despite the addition of the mechanically driven fuel pump. Especially when the engine is started in the cold, the burden on the starting device increases due to a decrease in the viscosity of the engine lubricating oil, and because it is difficult to rotate the crankshaft at sufficient speed, it is also difficult to sufficiently increase the fuel pressure, despite provision of the mechanically drive fuel pump.

Also, according to the invention disclosed in Japanese Laid-Open Patent Application No. 2002-89390, the burden on the manual starting device is greater, so the same problems as noted above arise. Japanese Laid-Open Patent Application No. 2002-89390 discloses increasing of the fuel pressure by pulling the knob of the fuel pressurization device before starting the starting operation, but in such a configuration, separate operations for the starting device and the fuel pressurization device must be performed when the engine is started, inevitably complicating the starting operation.

Also, according to the invention disclosed in Japanese Laid-Open Patent Application No. 2005-330815, and according to the invention disclosed in Japanese Laid-Open Patent Application No. 2002-89390, it is necessary to provide a mechanically driven fuel pump or a fuel pressurization device in addition to the conventionally used manually operated starting device, leading to problems regarding an increase in the size and weight of the engine as well as the cost.

Furthermore, when the mechanically driven fuel pump disclosed in Japanese Laid-Open Patent Application No. 2005-330815, or the fuel pressurization device disclosed in Japanese Laid-Open Patent Application No. 2002-89390 is provided, due to extra mechanical parts being inserted in the fuel flow channel that reaches from the fuel pump to the injector, the fuel circulation efficiency decreases, so it is necessary to use a larger electric fuel pump with higher pump performance. When a large electric pump is used, not only do costs increase, but the burden on the generator increases, so it is necessary to prepare a larger generator attached to the engine than that required conventionally, leading to an increase in engine size. Also, when using a larger generator than in the past, the burden on the starter increases, making a decrease in engine startability unavoidable.

It is an object of the present invention to provide a battery-less fuel injection system that can prevent the incidence of large-particle-diameter fuel being repeatedly injected from the injector due to insufficient fuel pressure and of engine starting becoming more difficult, without adding extra mechanical parts such as a mechanically driven fuel pump, a fuel pressurization device, etc.

SUMMARY OF THE INVENTION

The present invention is applied to a fuel injection system for an engine, the system supplying fuel to an engine started by a manually operated starting device. In one aspect of the present invention, there are provided an injector provided so as to supply fuel to the engine, an electrically powered fuel pump for supplying fuel to the injector, a fuel pressure sensor for detecting the pressure of the fuel supplied from the fuel pump to the injector, and an ECU for controlling the injector so as to perform the fuel injection to operate the engine. The injector, the fuel pump, and the ECU are provided so as to be activated by a generator driven by the engine. The ECU comprises starting state injection control means for controlling the fuel injection performed by the injector when the engine is started, and steady-state injection control means for controlling fuel injection performed by the injector after starting of the engine is completed. The starting state injection control means is configured so as to suspend execution of the fuel injection when the fuel pressure detected by the fuel pressure sensor is a set pressure or less in the process of starting the engine, and to have the injector perform the first fuel injection after it is confirmed that the fuel pressure detected by the fuel pressure sensor has exceeded the set pressure.

As noted above, when the starting state injection control means is configured so that, when the fuel pressure detected by the fuel pressure sensor is a set pressure or less in the process of starting the engine, execution of fuel injection is suspended, and the first fuel injection is performed by the injector after the fuel pressure detected by the fuel pressure sensor is confirmed to have exceeded the set pressure, it is possible to prevent fuel from being injected in a state in which the fuel pressure is insufficient when the engine is started. Therefore, it is possible to prevent the incidence of large particle diameter fuel from being injected from the injector, and fuel being insufficiently vaporized. Therefore, according to the configuration noted above, it is possible to prevent engine starting from becoming difficult when the engine is started in a state in which there is insufficient pressure of the fuel given to the injector from the fuel pump, such as when starting an engine that has been stopped for a long time.

Further, when the configuration is adopted as noted above, it is possible to simplify the configuration of the fuel injection system, because it is not necessary to provide a mechanically driven fuel pump or fuel pressurization device driven in conjunction with the starting device to address the problem of engine startability worsening because large particle diameter fuel is injected due to insufficient fuel pressure.

Further, when adopting the configuration as noted above, because extra mechanical parts are not inserted in the fuel flow channel that extends from the fuel pump to the injector, it is possible to prevent a decrease in fuel circulation efficiency, and also possible to prevent any incidence of engine starting difficulty due to large particle diameter fuel being injected due to insufficient fuel pressure, without using a particularly large electric fuel pump. Therefore, it is possible to improve engine startability, without using a particularly large generator attached to the engine.

In another aspect of the present invention, further provided is a temperature sensor for detecting the temperature in which the engine body temperature or the ambient temperature is reflected. In this case, the starting state injection control means is configured so as to suspend execution of the fuel injection when the temperature detected by the temperature sensor in the process of starting the engine is a set temperature or less, and the fuel pressure detected by the fuel pressure sensor in the process of starting the engine is a set pressure or less; and to have the injector perform the first fuel injection after it is confirmed that the fuel pressure detected by the fuel pressure sensor has exceeded the set pressure. The starting state injection control means is also configured so as to have the injector perform the first fuel injection when the temperature detected by the temperature sensor in the process of starting the engine exceeds the set temperature, even when the fuel pressure detected by the fuel pressure sensor in the process of starting engine is the set pressure or less.

When adopting the configuration as noted above, it is possible to prevent large particle diameter fuel from being injected from the injector due to insufficient fuel pressure when starting an engine that has been in a stopped state for a long time in cold regions, thus avoiding a situation in which starting the engine is difficult.

In the present invention, when performing the initial fuel injection in a state with high engine temperature when starting, the use of fuel pressure is not precluded as a condition for enabling the fuel injection necessary for starting the engine. For example, the starting state injection control means can be configured so that fuel injection is not performed when the fuel pressure is too low, even when the engine temperature exceeds a set temperature.

DETAILED DESCRIPTION OF THE EMBODIMENTS

Figure 1:
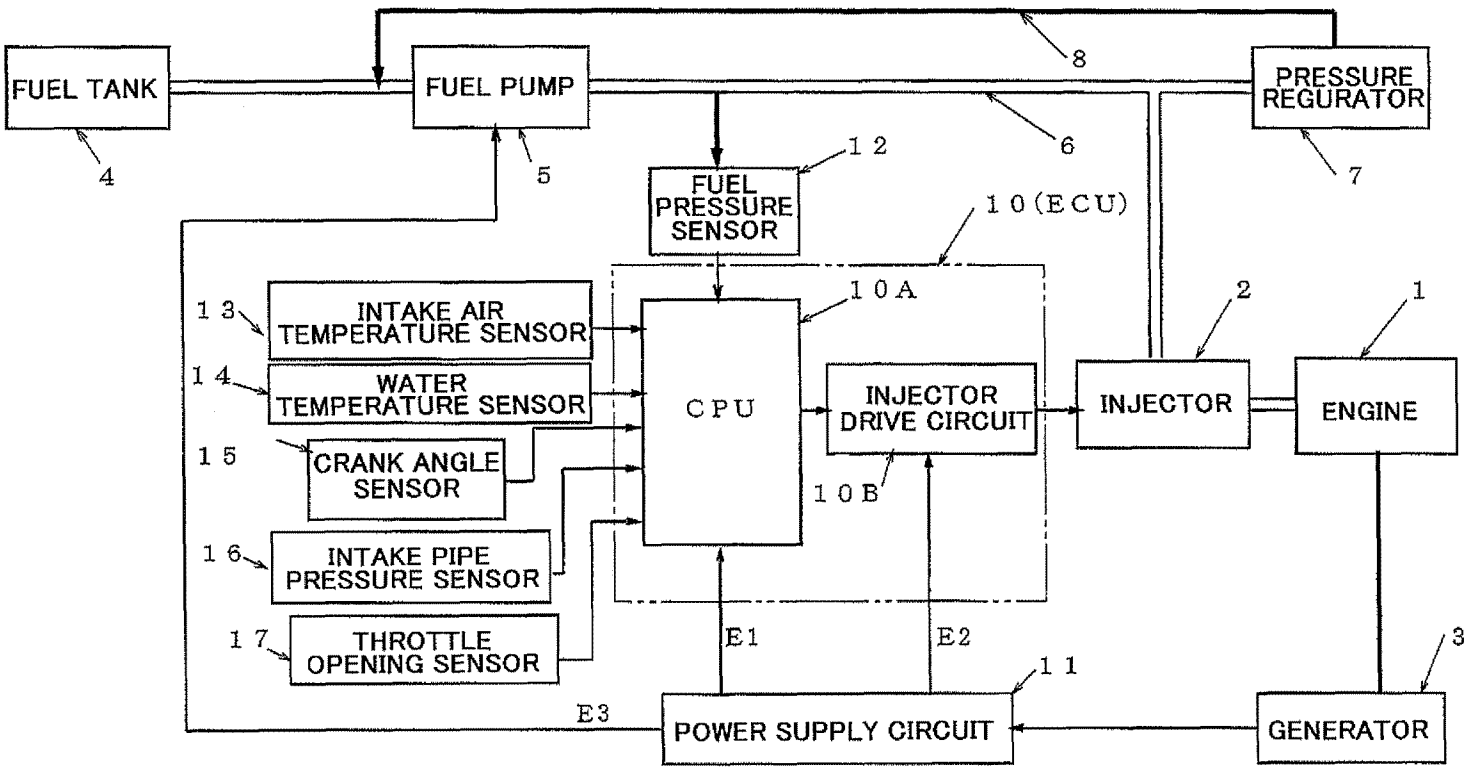
FIG. 1 is a block diagram schematically showing the configuration of an embodiment of the fuel injection control system of the present invention.

Embodiments of the present invention are described in detail below with reference to the drawings. FIG. 1 shows an embodiment of the fuel injection control system of the present invention. In FIG. 1, reference symbol 1 is an engine for driving a suitable load that may be used in an extremely low temperature environment, such as a snowmobile, 2 is an injector for injecting fuel inside the cylinder of the engine 1, and 3 is a generator attached to the engine 1.

The engine 1 can be a 4-cycle engine or a 2-cycle engine, but in this embodiment the engine 1 is a 4-cycle engine. The engine 1 can have a single cylinder or multiple cylinders. In the present specification, the engine has n cylinders (n is an integer of 1 or greater). The load driven by the engine 1 does not have a battery mounted, and cannot be provided with a starter motor for starting the engine, therefore the engine 1 is started by a manually operated starting device, such as a recoil starter or a kick starter, etc.

The injector 2 is provided with, for example, an injector body having a fuel supply port and a fuel injection port; a valve for opening and closing the fuel injection port, the valve being housed inside the injector body; a spring for biasing the valve to the closed position side; and a solenoid for displacing the valve to the open position side in resistance to the biasing force of the spring when excited. The injector 2 is provided so as to inject fuel inside the intake pipe of the engine, inside the intake port immediately before the intake hole of the engine, or inside the cylinder of the engine. Also, when the engine is a 2-cycle engine, the injector may be provided so as to inject fuel inside the crankcase of the engine.

The intake pipe of the engine may be provided for each cylinder of the engine, or may be provided in common for a plurality of cylinders of the engine. With the present invention, the injector 2 can be attached to any part of the engine, but with the present embodiment, the injector is provided at each cylinder of the engine, and the injector corresponding to each cylinder is attached to the engine in a state with the fuel injection port opened inside the intake pipe or inside the intake port of the corresponding cylinder of the engine. With the present embodiment, the engine 1 is a 4-cycle, 3-cylinder engine, and the injectors respectively corresponding to the first to third cylinders of the engine are the first to third injectors.

The injector 2 opens its valve and injects fuel when an injection pulse having a predetermined pulse width is given to the solenoid thereof. During the time from when the injection pulse is given to the injector 2 until the valve actually opens, there is a fixed delay time (invalid injection time). Therefore, the time when the injector actually injects fuel (actual injection time) is equal to the time obtained by subtracting the invalid injection time from the injection pulse signal width (time width). The amount of fuel injected from the injector is determined by the product of the actual injection time and the pressure of the fuel given to the injector (fuel pressure). Therefore, when the pressure of the fuel given to the injector is kept constant, it is possible to manage the fuel injection amount from the injector using the time width of the injection pulse given to the injector 2.

The generator 3 comprises a rotor attached to the crankshaft of the engine 1, and a stator fixed to the case of the engine, etc., and outputs AC voltage synchronously with the rotation of the engine. Any configuration may be used for the generator 3 used in the present invention, but in the present embodiment, the generator 3 is a known permanent magnet generator comprising: a magnet rotor for which a permanent magnet is attached to the inner periphery of the peripheral wall part of a cup-shaped flywheel attached to the crankshaft; and a stator for which an armature coil is wound on an iron core having a magnetic pole part facing the magnetic pole of the magnet rotor.

In a vehicle in which the engine 1 is mounted, a fuel tank 4 is provided in which fuel supplied to the injector 2 is stored, and the fuel inside this fuel tank is supplied to the fuel supply port of the injector 2 through an electrically powered fuel pump 5 and a delivery pipe 6. To keep the pressure of the fuel given to the injector 2 at a set pressure, a pressure regulator 7 is connected to the delivery pipe 6. The pressure regulator 7 keeps the pressure of the fuel given to the injector 2 at the set pressure by returning a portion of the fuel inside the delivery pipe 6 through a return pipe 8 to the inlet port side of the fuel pump 5 or to inside the fuel tank when the pressure of the fuel given to the injector 2 exceeds the set pressure.

To control the injector 2, an ECU (Electronic Control Unit) 10 is provided. The ECU 10 is provided with a CPU 10A for generating injection command pulses at an injection timing set for each cylinder, and an injector drive circuit 10B for giving injection pulses to the injector 2 provided to each cylinder when the injection command pulse is given from the CPU 10A at the injection timing set for each cylinder.

Based on various control conditions, the ECU 10 controls the timing for injecting fuel from the injector 2 (injection timing), and the amount of fuel injected from the injector 2 (injection amount). The injector drive circuit 10B is provided respectively on the first to third cylinders of the engine, and when the injection command pulse is given to the injector drive circuit 10B corresponding to each cylinder from the CPU 10A, the injection pulse is given to the injector 2 provided to each cylinder from the injector drive circuit 10B corresponding to each cylinder.

On the ECU 10, in addition to the illustrated constituent elements, an I/O interface for inputting data to the CPU 10A and outputting data from the CPU 10A, and a storage device for storing data used for control and programs executed by the CPU 10A, etc., are further provided, but are not shown.

Also, on the ECU 10, circuits required to configure an ignition system for igniting the engine, etc. are further provided, but these circuits are also not shown.

The AC voltage outputted by the generator 3 is inputted to a power supply circuit 11. The power supply circuit 11 converts the AC voltage outputted by the generator 3 to DC voltage E1 given to the power supply terminal of the ECU 10, DC voltage E2 given to the solenoid of the injector 2 through the injector drive circuit 10B, and power supply voltage E3 given to the power supply terminal of the fuel pump 5. Therefore, with the present embodiment, the injector 2, the fuel pump 5, and the ECU 10 are driven with the generator 3 driven by the engine 1 as the power supply.

The ECU 10 is configured with starting state injection control means for controlling fuel injection performed by the injector 2 when the engine 1 is started, and steady-state injection control means for controlling fuel injection performed by the injector 2 after starting of the engine 1 is completed by having the CPU 10A execute a predetermined program.

To obtain information used for controlling the injector 2, there are provided a fuel pressure sensor 12 for detecting the fuel pressure which is the pressure of the fuel given to the injector 2, an intake air temperature sensor 13 for detecting the intake air temperature of the engine 1, a water temperature sensor 14 for detecting the temperature of the coolant of the engine 1, a crank angle sensor 15 for generating crank angle signals when the rotation angle position of the crankshaft of the engine matches a set reference rotation angle position, an intake pipe pressure sensor 16 for detecting the pressure inside the intake pipe of the engine 1, and a throttle opening sensor 17 for detecting the opening degree of the throttle valve (throttle opening), and the output of these sensors are inputted to the CPU 10A.

In the present invention, when controlling the fuel injection when the engine is started, a temperature sensor is used for detecting the temperature in which the engine body temperature or the ambient temperature is reflected. As the temperature sensor for detecting the temperature in which the engine body temperature is reflected, it is possible to use a water temperature sensor for detecting the temperature of the engine coolant, or an engine body temperature sensor for detecting the temperature of the engine body. Also, as the temperature sensor for detecting the temperature in which the engine ambient temperature is reflected, it is possible to use an intake air temperature sensor for detecting the temperature of the air taken into the engine intake pipe, or a fuel temperature sensor for detecting the temperature in which the temperature of the fuel supplied to the injector 2 is reflected, etc. With the present embodiment, as the temperature sensor for detecting the temperature in which the engine body temperature is reflected, a water temperature sensor 14 is used, and fuel injection during starting of the engine is controlled as one control condition for the temperature detected by this water temperature sensor.

The fuel pressure sensor 12 is configured by, for example, a pressure responding element such as a diaphragm for responding to pressure inside the delivery pipe 6, and a transducer for converting the displacement of this pressure responding element or the pressure applied to said pressure responding element to a parameter that can be electrically detected, such as a resistance value, electrostatic capacity, etc. Also, for the intake air temperature sensor 13, the water temperature sensor 14, the intake pipe pressure sensor 16, and the throttle opening sensor 17, it is possible to use the same items as those used for conventional fuel injection control systems.

Figure 8A:
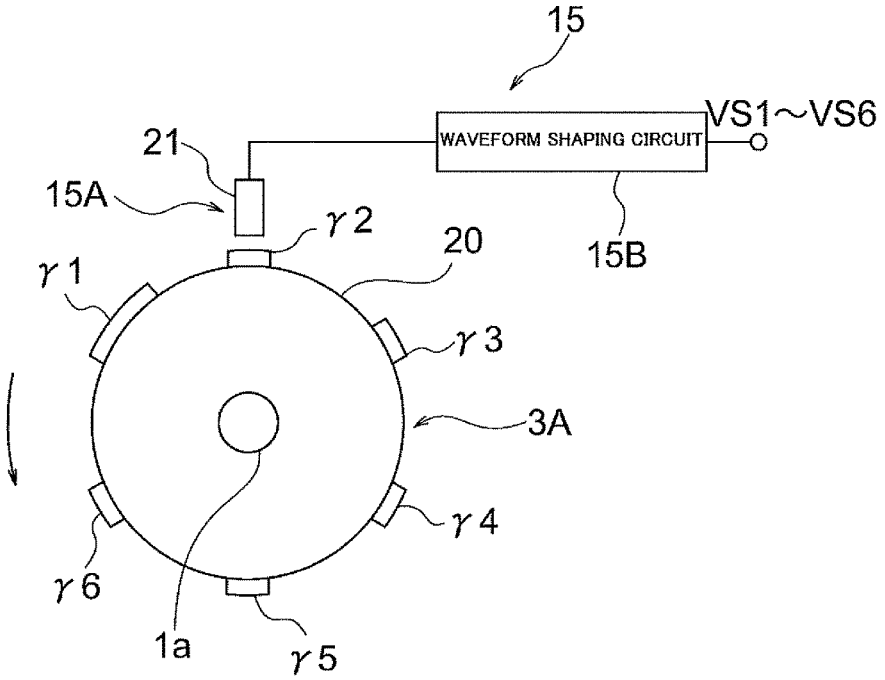
FIGS. 8 (A) and (B) are configuration diagrams schematically showing configuration examples with different crank angle sensors that can be used with the fuel injection control system of the present invention.
Figure 8B:
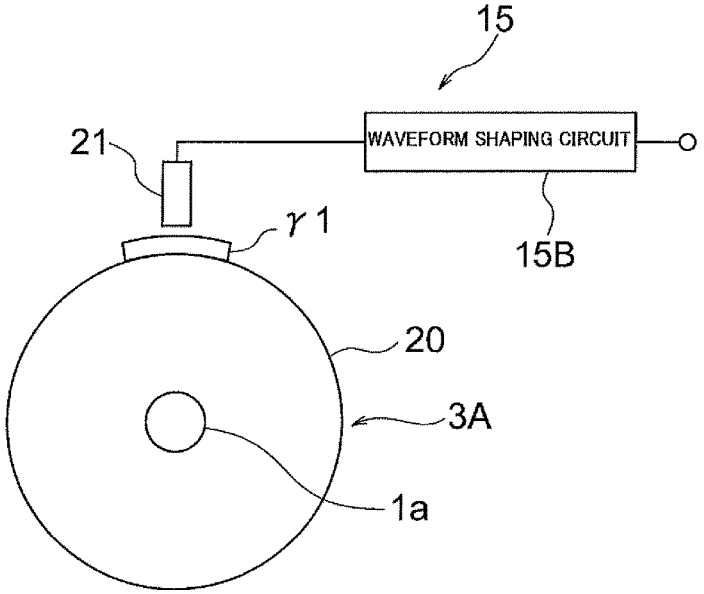

The crank angle sensor used with the present embodiment comprises a signal generator for generating pulse signals with a plurality of preset reference rotation angle positions of the crankshaft, and a waveform shaping circuit for converting the pulse signals generated by the signal generator to crank angle signals of the waveforms that can be recognized by the CPU. Referring to FIG. 8 (A), the configuration of the crank angle sensor 15 used with the present invention is shown. With this example, the crank angle sensor 15 comprises a signal generator 15A and a waveform shaping circuit 15B for converting output signals of the signal generator 15A. The signal generator 15A comprises a plurality of reluctors (inductors) r1 to r6 consisting of arc-shaped projections provided on the outer periphery of the cup-shaped flywheel 20 attached to the crankshaft la of the engine 1, and an electromagnetic pickup 21 arranged opposed to the outer periphery of the flywheel 20. The electromagnetic pickup generates pulses of different polarities when the respective front end side edge and the back end side edge in the rotation direction (arrow direction in the drawing) of the reluctors r1 to r6, are detected. The waveform shaping circuit 15B converts output signals of electromagnetic pickup 21 to rectangular wave shaped crank angle signals that the CPU can recognize.

Figures 11A, 11B, 11C, 11D, 11E, 11F:
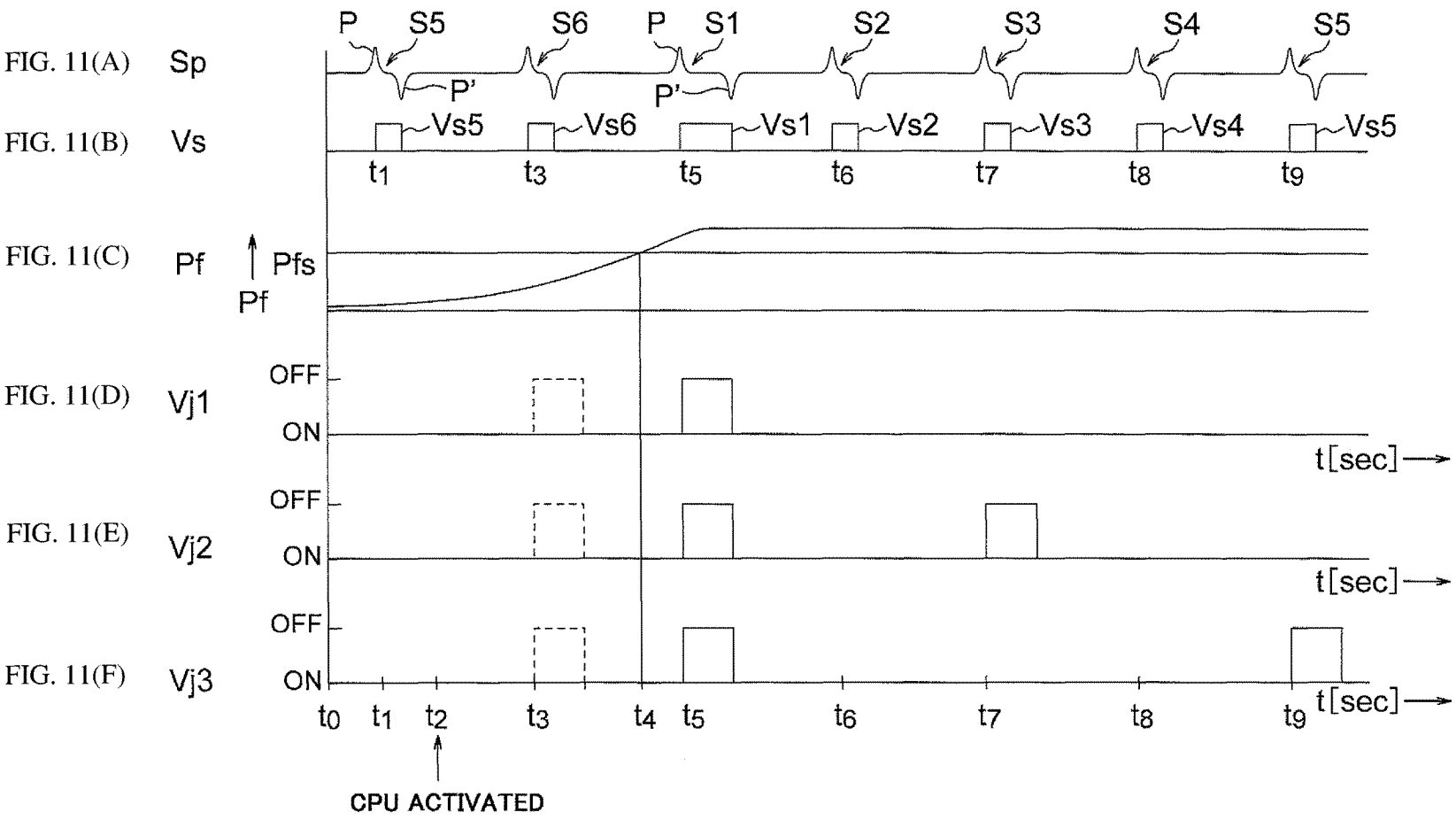
FIG. 11 (A) to (F) are timing charts used to explain an example of the operation of the embodiment of the present invention.

When the reluctors r1 to r6 are detected, the electromagnetic pickup 21 outputs signals S1 to S6 of pulse waveforms such as those shown in FIG. 11 (A), for example. Each signal comprises a positive polarity pulse p generated when the front end side edge of the reluctor in the rotation direction is detected by the electromagnetic pickup, and a negative polarity pulse p' generated when the back end side edge of the reluctor is detected.

The shape and arrangement of reluctors r1 to r6 are contrived to make it possible for the CPU 10A to determine a reference rotation angle position of the crankshaft at which each of signals S1 to S6 is outputted from the electromagnetic pickup 21. With the present embodiment, the pole arc angle of one reluctor r1 is set to be greater than the pole arc angle of the other reluctors r2 to r6. Since the pole arc angle of the reluctor r1 is set to be greater than the pole arc angle of the other reluctors, the interval between the generating positions of the positive polarity pulse p and the negative polarity pulse p' configuring the signal S1, is broader than the interval between the generating positions of the positive polarity pulse p and the negative polarity pulse p' configuring each of the signals S2 to S6.

The waveform shaping circuit 15B comprises a hardware circuit, and generates rectangular wave shaped crank angle signals that rise when a positive polarity pulse p greater than a threshold value is generated, and falls when a negative polarity pulse signal p' is generated. This crank angle signal is inputted to the interrupt input terminal of the CPU 10A. The CPU 10A performs a crank angle signal interrupt process each time the crank angle signal is inputted to the interrupt input terminal. In the interrupt process, the CPU performs a signal determination process for determining the reference rotation angle position at which each of the crank angle signals S1 to S6 was generated, a process for detecting the engine rotation speed from the crank angle signal generation interval, and a process for determining whether to have the injector perform initial fuel injection when starting, or perform fuel injection during steady state operation, etc.

With the present embodiment, permanent magnets are attached to the inner periphery of the peripheral wall part of the flywheel 20, and a magnet rotor 3A is configured by the flywheel 20 and the magnets attached to the flywheel 20. The magnet rotor 3A constitutes the generator 3 together with a stator (not illustrated) that is arranged on the inside of the flywheel 20.

Though not illustrated, inside the ECU 10, a signal conversion circuit as an input interface for converting signals obtained from each sensor to electric signals that the CPU 10A can recognize is provided in addition to the waveform shaping circuit 15B. A power supply voltage is required to operate these interfaces, and as this power supply voltage, the power supply voltage E 1 given to the CPU 10A is used.

When power supply voltage of the CPU 10A is established, the CPU performs power-on reset to initialize each part thereof. After initialization of each part is performed, the CPU 10A performs a signal determination process for a series of crank angle signals inputted sequentially during one rotation of the crankshaft, for determining a reference rotation angle position at which each crank angle signal was generated, and specifies the regular fuel injection timing based on the crank angle signal for which correspondence with the reference rotation angle position was determined. In this signal determination process performed by the CPU 10A, for example, when a wide pulse width crank angle signal Vs1 subsequent to a narrow pulse width crank angle signal Vs6 is detected, or when a narrow pulse width crank angle signal Vs2 subsequent to a wide pulse width crank angle signal Vs1 is detected, it is determined that the crank angle signal Vs1 is a crank angle signal generated at the first reference rotation angle position, and it is determined that the crank angle signals Vs2, Vs3, . . . , Vs6 detected in sequence thereafter are respectively crank angle signals generated at the second through sixth reference rotation angle positions. With the example shown in FIG. 11, the CPU 10A of the ECU 10 is activated at time t2, and if we assume the CPU 10A was able to recognize the rectangular wave signal Vs6, determination of correspondence relation between the crank angle signal and the reference rotation angle position is completed when the rectangular wave signal Vs1 is detected at time t5. The signal determination process noted above is completed while the crankshaft does at least one rotation, after the power-on reset of the CPU 10A is completed.

In the present embodiment, the timings at which crank angle signals Vs1, Vs3, and Vs5 are generated respectively are the regular fuel injection timings of the first cylinder to the third cylinder of the engine. Therefore, the ECU 10 specifies the respective timing at which the crank angle signals Vs1, Vs3, and Vs5 are generated as the regular fuel injection timing of the first cylinder to the third cylinder. The regular fuel injection timing is set to a suitable timing so that the air-fuel ratio of the air fuel mixture that exists inside the combustion chamber when igniting the engine is a value suitable for combustion.

When the CPU 10A causes fuel injection to be performed by the injector 2, the CPU 10A gives to the injector drive circuit 10B an injection command pulse having a pulse width equivalent to the time for which invalid injection time is added to the fuel injection time. In the present embodiment, the invalid injection time is the delay time from when the injection pulse is given to the injector until the injector valve opens, and during this invalid injection time, fuel injection is not performed. The injector drive circuit 10B is provided for each cylinder of the engine, and when injection command pulses for each cylinder are given from the CPU 10A, an injection pulse having a pulse width equal to the pulse width of the injection command pulse is given to the corresponding injector 2. The injector 2 opens the injector valve during the actual fuel injection time obtained by subtracting the invalid injection time from the time width of the given injection pulse, and performs fuel injection to inside the intake pipe or inside the intake port provided on the corresponding cylinder.

Figure 7:
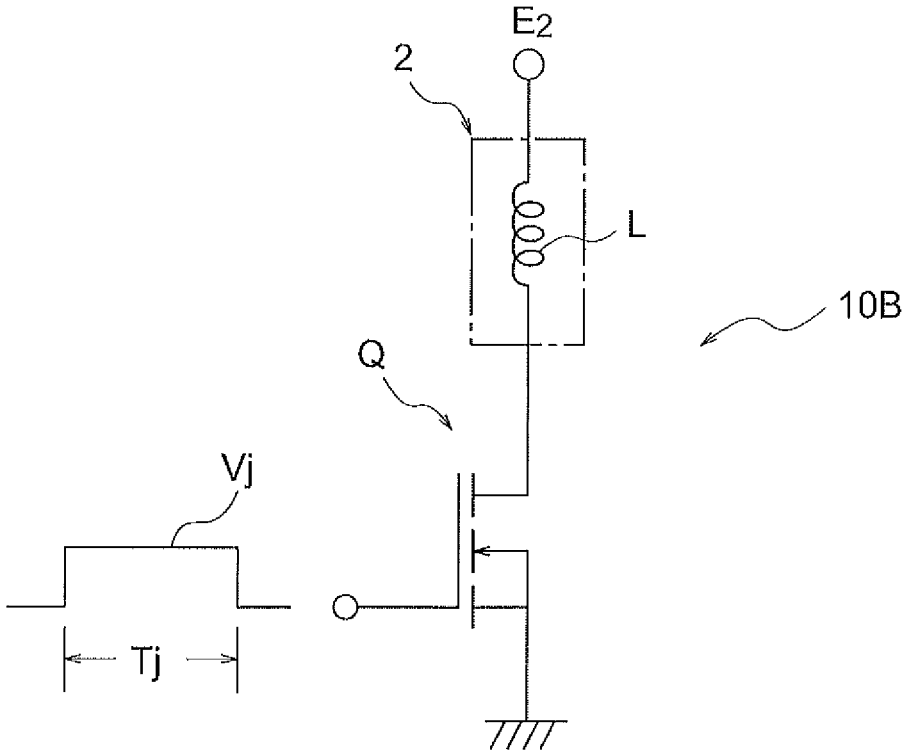
FIG. 7 is a circuit diagram showing an example of an injector drive circuit used with the fuel injection control system of the present invention.

As shown in FIG. 7, for example, the injector drive circuit 10B is configured of a semiconductor switch Q connected in series to a solenoid L of the injector 2. With the example shown in FIG. 7, a MOSFET is used as the semiconductor switch Q. A drain of the MOSFET is connected through the solenoid L to the plus side output terminal (non-grounded side output terminal) of a power supply circuit 11, and a source of the MOSFET is connected to the minus side output terminal (grounded side output terminal) of the power supply circuit 11. Through a driver circuit that is not illustrated, the CPU 10A gives rectangular wave shaped injection command pulse Vj between the gate and source of the MOSFET configuring the switch Q. The switch Q maintains an on state while the injection command pulse Vj is given, and applies the injection pulse to the solenoid of the injector 2. A time width Tj of the injection command pulse Vj is set to the time correlating to the sum of the time the injector 2 valve is open (actual fuel injection time) Ti and the invalid injection time To $$(Tj=Ti+To).$$

In order to have the necessary amount for the amount of fuel injected from the injector 2 for each cylinder, the CPU 10A controls the amount of fuel injected inside the cylinder of the engine 1 from each injector by adjusting the pulse width of the injection pulse given to the injector according to various control conditions.

When controlling the fuel injection amount, the CPU 10A calculates the intake air amount to inside the cylinder of the engine, and according to the calculated intake air amount, calculates as the basic fuel injection amount the amount of fuel injection necessary for the air-fuel ratio of the air fuel mixture inside the cylinder to be a predetermined value, and calculates as the basic injection time Tib the actual injection time necessary to have fuel of this basic fuel injection amount injected from the injector. By correcting this basic injection time according to various control conditions, the actual injection time necessary to have the optimal operation performed by the engine is calculated.

The intake air amount calculation can be performed using the speed density method for calculating the intake air amount based on the engine rotation speed detected from the interval of crank angle signals generated by the crank angle sensor 15, the intake pipe internal pressure (absolute pressure) detected by the intake pipe pressure sensor 16, and the intake air temperature detected by the intake air temperature sensor 13. The intake air amount calculation can also be performed using the speed throttle method that indirectly calculates the intake air amount from the engine rotation speed and the throttle opening detected by the throttle opening sensor 17. It is also possible to provide an air flow meter for detecting the amount of air taken into the engine intake manifold, and have the intake air amount detected directly by this air flow meter.

The actual injection time Ti that determines the injection amount of fuel actually injected from the injector 2 is calculated by correcting the basic injection time Tib according to a parameter or parameters such as the throttle opening detected by the intake air amount throttle opening sensor 17, the engine coolant temperature detected by the water temperature sensor 14, and the engine rotation speed and the engine acceleration/deceleration ratio, etc. detected from the crank angle signal obtained from the crank angle sensor 15.

Also, when the engine is started in a low temperature environment, it is necessary to increase the fuel injection amount, so in the time until starting of the engine is completed, start time increase control is performed for increasing the fuel injection amount according to the coolant temperature and outside air temperature, etc.

For the method of controlling the fuel injection amount, various methods are known, and correction of the fuel injection amount can be performed as appropriate according to the characteristics required for the engine, but with the present invention, any method can be used for controlling the fuel injection amount.

When the engine 1, which does not have a battery mounted, is started using a manually operated starting device, such as a recoil starter, etc., within the slight time in which starting operation is performed (normally during 5 to 6 rotations of the crankshaft), the fuel pump 5 is driven by the output of the generator 3, which is driven by the engine 1, and the pressure of the fuel given to the injector 2 needs to be increased to a predetermined pressure. When the time the engine has been stopped is relatively short, the pressure of the fuel inside the piping for giving fuel to the injector from the fuel pump is kept at a relatively high pressure, and it is easy to increase the fuel pressure to the predetermined pressure with a single crank. However, when the engine has been stopped for a long time, the pressure of the fuel inside the piping for giving fuel to the injector from the fuel pump decreases, so it is difficult to increase the fuel pressure to the predetermined pressure with a single starting operation, and it is often necessary to perform starting operation many times to increase the fuel pressure.

When the operation of injecting fuel to the injector is performed in a state with insufficient fuel pressure in the process of repeated starting operation, it is not possible to inject sufficiently atomized fuel from the injector, so large particle diameter fuel is injected inside the intake pipe or inside the cylinder of the engine (inside the combustion chamber). When large particle diameter fuel is injected inside the intake pipe or inside the cylinder, it is difficult to sufficiently vaporize the fuel, so it is not possible to obtain the air fuel mixture with the predetermined air-fuel ratio, and engine startability decreases significantly.

Particularly as in the case of starting an engine mounted in a snowmobile, when the engine is started at a low temperature (0° C. or less, for example), due to a decrease in viscosity of the engine lubricating oil, there is a marked increase in the burden on the driver when starting operation of the engine is performed, and it is not possible to rotate the crankshaft at sufficient speed, so it is difficult to raise the output voltage of the generator when the starting operation is performed, and there is notable occurrence of the problems noted above.

Accordingly, in the present embodiment, the CPU 10A inside the ECU is programmed so as to constitute the starting state injection control means for controlling fuel injection performed by the injector when the engine is started, and the steady state injection control means for controlling fuel injection performed by the injector after engine start is completed, configured, and with the starting state injection control means, injection control is performed that is suited for addressing the above-mentioned problems that occur during engine starting.

In the present embodiment, the starting state injection control means is configured so that, when the temperature detected by the temperature sensor is the set temperature or less, and the fuel pressure detected by the fuel pressure sensor 12 is the set pressure or less in the process of starting engine, fuel injection from the injector is suspended, and the first fuel injection is performed after the fuel pressure exceeds the set pressure, and when the temperature detected by the temperature sensor in the process of starting engine 1 exceeds the set temperature, the first fuel injection is performed by the injector even when the fuel pressure detected by the fuel pressure sensor is the set pressure or less. With the present embodiment, the water temperature sensor 14 for detecting the temperature of the engine coolant is used as the abovementioned temperature sensor for detecting the temperature in which the engine body temperature or the ambient temperature is reflected.

When the temperature detected by the water temperature sensor 14 is the set temperature or less in the process of starting the engine, the ECU 10 suspends fuel injection from the injector 2 during the time until the fuel pressure detected by the fuel pressure sensor 12 exceeds the set pressure, and the ECU has the injector 2 perform the initial fuel injection after the fuel pressure detected by the fuel pressure sensor 12 is confirmed to have exceeded the set pressure. When the water temperature detected by the water temperature sensor 14 exceeds the set temperature in the process of starting the engine, the first fuel injection from the injector 2 is also performed even when the fuel pressure detected by the fuel pressure sensor 12 is the aforementioned set pressure or less.

The above-mentioned set temperature and set pressure can be determined by experimentation. For example, after starting the engine starting operation in a state with the fuel pressure at approximately zero, when the initial fuel injection is performed at the injection timing detected at first, an experiment to confirm whether or not it is possible to start the engine is performed while varying the start time engine coolant temperature in small temperature increments, and with this experiment, it is possible to use as the above-mentioned set temperature the lower limit temperature in the temperature range for which it is confirmed that the engine can be started.

Also, in a state with the temperature of the engine coolant at the set temperature or less, when the initial fuel injection is performed at the injection timing first detected after the start of the starting operation, the experiment for confirming whether or not it is possible to start the engine is performed while variously changing the pressure of the fuel given to the injector at the start of the starting operation (fuel pressure at the start of the starting operation), and it is possible to use as the above-mentioned set pressure Pfs the lower limit value of the fuel pressure at the start of the starting operation for which it was confirmed that it is possible to start the engine.

The experiment performed to determine the set temperature set for the temperature in which the engine body temperature is reflected, and the set pressure set for the fuel pressure, is not limited to the example noted above, and it is also possible to perform experiments for determining the set temperature and the set pressure considering the engine use environment, the number of repetitions of the starting operation allowed during starting of the engine, individual differences in operating power that can be added to the starting device when the engine is started, etc. and various other conditions.

FIG. 11 is referenced to describe an example of the operation when starting a battery-less fuel injection system of the present embodiment. As described previously, FIG. 11 (A) and (B) respectively show pulse signals generated by the signal generator configuring the crank angle sensor, and the crank angle signals obtained with waveform shaping of the pulse signals. Also, FIG. 11 (C) shows the fuel pressure Pf detected by the fuel pressure sensor 12, and FIG. 11 (D) through (F) respectively show the injection command pulses Vj1 through Vj3 given to the injector drive circuit for driving the first through third injectors respectively provided on the first through third cylinders of the engine. With the present embodiment, because a long time elapses until the engine starts, the fuel pressure Pf is significantly lower than the set pressure Pfs, and is almost 0. Also, with the example shown in FIG. 11, the temperature detected by the water temperature sensor 14 is less than the set temperature (e.g. 0° C.).

It is assumed that starting operation performed by the starting device starts at time to. When the operation starts, the generator 3 generates a voltage, so the fuel pump 5 is driven, and fuel inside the fuel tank 4 is fed to the injector 2. By doing this, the pressure Pf of the fuel given to the injector 2 rises. To have the fuel from the injector be injected in a sufficiently atomized state, the fuel pressure Pf needs to exceed the set pressure Pfs.

In FIG. 11, after the starting operation starts at time t0, the CPU 10A of the ECU 10 is activated at time t2. When the CPU 10A is activated and power-on reset is performed, the output of various sensors and the crank angle signals are made to be detected by the CPU 10A. In FIG. 11, the crank angle signal Vs5 generated at time t1 is not detected by the CPU 10A, but the crank angle signal Vs6 generated at time t3 is detected by the CPU. At the point that the crank angle signal Vs6 is detected, the CPU 10A cannot determine for this crank angle signal at which reference rotation angle position this crank angle signal was generated, but when the crank angle signal Vs1 with a wider width than the crank angle signal Vs6 is detected at time t5, it is possible to determine for the crank angle signal at which reference rotation angle position the signal was generated.

With the conventional battery-less fuel injection system, as shown by the dotted line in FIG. 11 (D) through (F), when the crank angle signal Vs6 is detected at time t3 by the CPU 10A, the injection command pulses Vj1 through Vj3 are given simultaneously to the injector drive circuit 10B respectively driving the first through third injectors respectively corresponding to the first through third cylinders, and fuel injection was performed simultaneously by the first through third injectors.

However, when fuel is injected from the injector when in a state with the pressure of the fuel given to the injector lower than the set pressure, the particle diameter of the injected fuel thus becomes larger; therefore, it is not possible to sufficiently vaporize the injected fuel, and as described previously, a problem arises of starting the engine being difficult.

To prevent this kind of problem from arising, with the present embodiment, the ECU 10 is configured so as to be provided with starting state injection control means for controlling the fuel injection performed by the injector 2 at the time the engine 1 is started, and steady-state injection control means for controlling the fuel injection performed by the injector after starting of the engine 1 is completed. The starting state injection control means is configured so that when the temperature detected by the water temperature sensor 14 is a set temperature or less, and the fuel pressure detected by the fuel pressure sensor 12 is the set pressure or less in the process of starting the engine, injection of fuel from the injector 2 is suspended until it is confirmed that the detected fuel pressure has exceeded the set pressure, and the first fuel injection is performed from the injector 2 after it is confirmed that the fuel pressure detected by the fuel pressure sensor has exceeded the set pressure. The starting state injection control means is also configured so that when the temperature detected by the water temperature sensor 14 is the set temperature or less, but the fuel pressure detected by the fuel pressure sensor 12 exceeds the set pressure in the process of starting the engine 1 and also when the fuel pressure detected by the fuel pressure sensor 12 is the set pressure or less, but the temperature detected by the water temperature sensor 14 exceeds the set temperature in the process of starting the engine, fuel injection from the injector 2 is permitted. The steady state injection control means is a means for controlling the injector to inject the amount of fuel necessary to operate the engine after starting is completed, and with the present invention, any configuration of the steady state injection control means can be used.

With the present embodiment, when it is determined by the CPU 10A activated at time t2 shown in FIG. 11 that the temperature of the engine coolant is the set temperature or less, and the fuel pressure Pf detected by the fuel pressure sensor 12 is the set pressure Pfs or less, injection of fuel that was performed when the crank angle signal Vs6 was detected with the conventional fuel injection system is put on hold (suspended). Then, after the CPU 10A confirms at time t4 that the fuel pressure Pf has exceeded the set pressure Pfs, when the initial crank angle signal Vs1 is detected at time t5, as shown by the solid line in FIG. 11 (D) through (F), injection command pulses Vj1 through Vj3 are simultaneously given to the injector drive circuits 10B for the first through third cylinders, and the first fuel injection is performed by the injector of the first through third cylinders.

With the example shown in FIG. 11, when the crank angle signal Vs1 is detected at time t5, since that signal width is broader than the signal width of the crank angle signal Vs6 detected one item previously, it is possible to determine at which reference rotation angle position each crank angle signal was generated, so the fuel injection from the second time and thereafter is performed at the regular injection timing of each cylinder.

If the determination of crank angle signal has not been completed when it is confirmed that the fuel pressure Pf has exceeded the set pressure Pfs, it is preferable to have the injectors for all cylinders perform fuel injection simultaneously while conducting the control for limiting the fuel injection amount so that the fuel injection amount is not excessive, and to have the injector on each cylinder perform fuel injection at the regular injection timing of each cylinder specified based on the crank angle signal corresponding to each cylinder after determination of crank angle signals is completed. The control for limiting the fuel injection amount may be conducted by having all injectors perform fuel injection simultaneously with the injection time shortened than the injection time during the first fuel injection when every crank angle signals generates, or having perform all injectors fuel injection simultaneously with the same injection time as the injection time during the first fuel injection for example when every other crank angle signal generates.

After the first fuel injection is performed, when the crank angle signal determination is not completed, the ignition operation is performed by the ignition system each time a crank angle signal is generated, and when the crank angle signal determination is completed, ignition of each cylinder is performed during regular ignition time of each cylinder. When the initial explosion is performed with any cylinder by this ignition, the engine starts.

Though not shown in FIG. 11, even when the engine water temperature is the set temperature or less when the engine is started, if the fuel pressure Pf detected by the fuel pressure sensor exceeds the set pressure Pfs, without suspending fuel injection from each injector, the CPU causes the initial fuel injection to be performed simultaneously by injectors corresponding to all the cylinders when the crank angle signal is initially detected.

Figure 12:
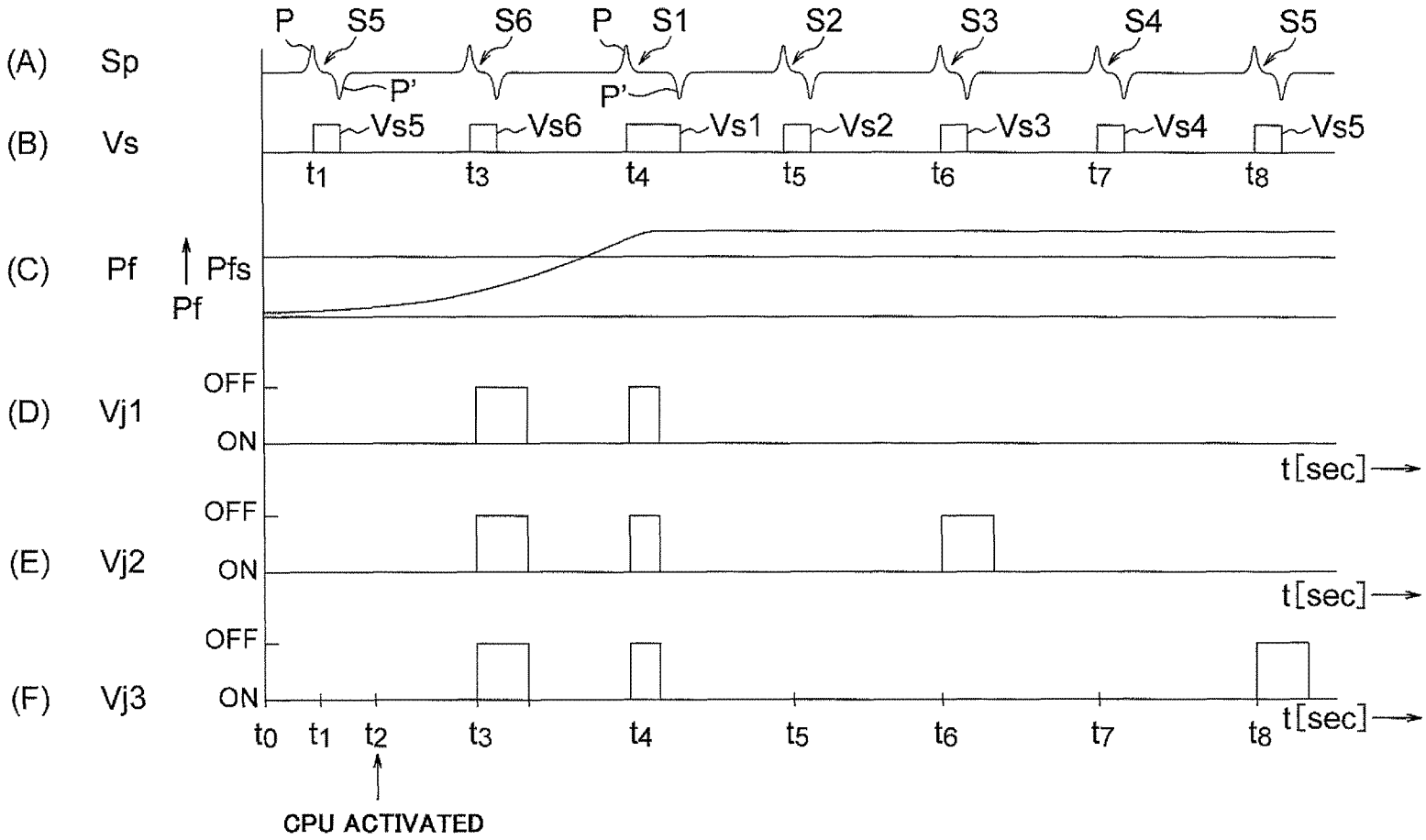
FIG. 12 is a timing chart used to explain another example of the operation of the embodiment of the present invention.

If the engine water temperature exceeds the set temperature when the engine is started, the injection command pulses Vj1 to Vj3 are simultaneously given to the injector drive circuit for driving the injectors for the first to third cylinders, as shown in FIG. 12, and fuel injection is simultaneously performed by all the injectors, even if the fuel pressure Pf is the set pressure Pfs or less when the crank angle signal Vs6 is generated at time t3. With the example shown in FIG. 12, after the initial fuel injection is performed when the crank angle signal Vs6 is generated at time t3, fuel injection is performed simultaneously with all cylinders in a state with the injection time limited when the next crank angle signal Vs1 is generated. With the example shown in FIG.12, it has become possible to determine at which crank angle position each crank angle signal was generated, by detection of the crank angle signal Vs1 with a wide pulse width generated at time t4, so the fuel injection thereafter is performed at the regular fuel injection timing of each cylinder.

With the configuration as in the present embodiment, it is possible to prevent injection of fuel from the injector in a state with insufficient fuel pressure when an engine that has been stopped for a long time in the cold is started. Therefore, it is possible to prevent the occurrence of a state in which large particle diameter fuel is injected, making sufficient vaporization of the fuel impossible, and to prevent difficulty in starting the engine.

Figure 4:
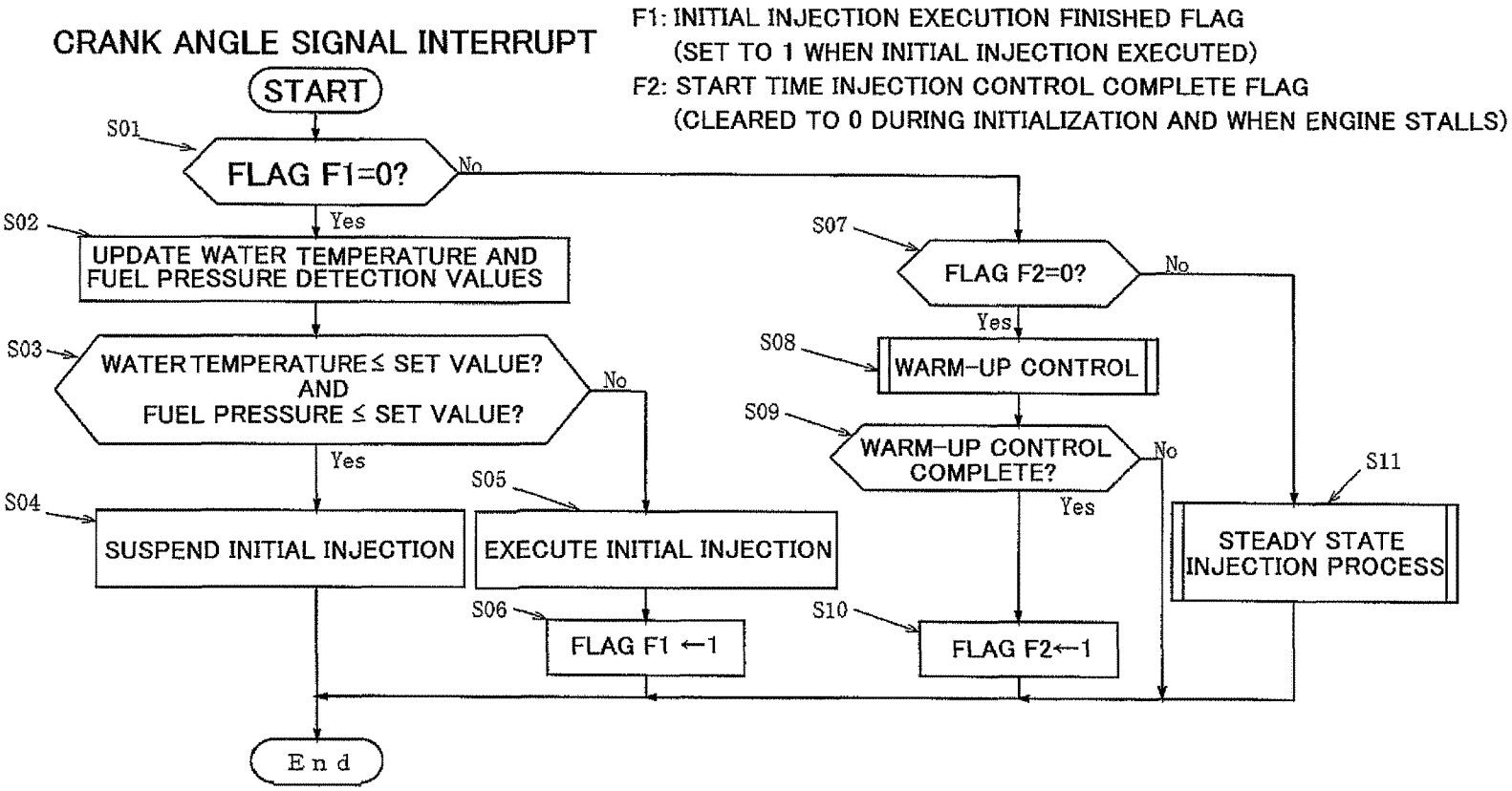
FIG. 4 is a flow chart showing an example of an algorithm of a process executed by the CPU of the ECU in the embodiment of FIG. 1.

Referring to FIG. 4, shown is the algorithm for the crank angle signal interrupt process executed by the CPU 10A each time a crank angle signal generated by the crank angle sensor is inputted to the interrupt input terminal of the CPU 10A, for configuring the starting state injection control means and the steady state injection control means.

In FIG. 4, among the processes actually performed by the crank angle signal interrupt process the only ones shown are: the process necessary for configuring the starting state injection control means, and the process necessary for transferring control by the starting state injection control means to control by the steady state injection control means. and not shown are: processes that can be performed in a conventional manner, such as the process of determining the generation position of each crank angle signal, the process of detecting the engine rotation speed, the process for specifying the crank angle position at which fuel injection is performed, and processes related to control of the engine ignition timing.

After power-on reset is performed by the CPU 10A, when the first crank angle signal is inputted to the CPU, the first crank angle signal interrupt process after the start of the starting operation is executed. With this first crank angle signal interrupt process, first, a determination is made at step S01 in FIG. 4 of whether the initial injection execution finished flag F1 is 0. The initial injection execution finished flag F1 is a flag for indicating whether or not the initial fuel injection after the start of the starting operation has been executed, and when the initial fuel injection has not yet been executed, the flag is reset to 0, and when the initial fuel injection has been executed, the flag is set to 1.

In step S01, when the initial injection execution finished flag F1 is determined to be 0, the process then goes to step S02, and the detection value of the engine coolant temperature read from the water temperature sensor 14 and the detection value of the fuel pressure read from the fuel pressure sensor 12 are updated. After step S02 is executed, the process goes to step S03, and a determination is made of whether the initial injection suspension conditions are established, which are that the newly detected coolant temperature is the set temperature or less, and the fuel pressure is the set pressure or less. As a result, when it is determined that the conditions are established, the process then goes to step S04, and after execution of the initial fuel injection, which was to be executed when generation of the crank angle signal was first detected, is put on hold, this process ends.

With the crank angle signal interrupt process shown in FIG. 4, when it is determined at step S03 that the initial injection suspension conditions are not established, specifically, when the condition that the water temperature is the set temperature or less and/or the condition that the fuel pressure is the set pressure or less is not established, the process goes to step S05, and the initial fuel injection is executed, and at step S06, the initial injection execution finished flag F1 is set to 1, and this process ends.

In the process shown in FIG. 4, at step S01, when it is determined that the initial injection execution finished flag F1 is not 0 (F1=1), the process advances to step S07, and a determination is made of whether flag F2 is 0. Flag F2 is the start time injection control complete flag, and is reset to 0 when the CPU 10A undergoes power-on reset, and when the engine 1 stalls. At step S07, when it is determined that flag F2 is 0, the process goes to step S08, the start time fuel injection control is performed to perform the warm-up operation of the engine, and next at step S09, a determination is made of whether the warm-up operation is completed. At step S09, when it is determined that the warm-up operation is not completed, the process of FIG. 4 ends, and when it is determined that the warm-up operation is completed, the process goes to step S10, flag F2 is set to 1, and this process ends.

With the process in FIG. 4, when it is determined at step S07 that the flag F2 is not 0 (F2=1) (when it is determined that the start time injection control is completed), the process goes to step S11, and the steady state injection process is performed. The steady state injection process is a process for configuring the steady state injection control means which is the means for controlling fuel injection from the injector during steady state operation of the engine after starting of the engine is completed.

With the steady state injection process, the amount of fuel to be injected from the injector of each cylinder is determined in relation to, for example, the throttle opening detected by the throttle opening sensor 17, and the separately calculated engine rotation speed, and to inject the determined amount of fuel from each injector, the pulse width of the injection command pulse to be given to the injector drive circuit for driving each injector is determined, and when the crank angle signal generation timing inputted at the time is the injection timing at which fuel injection is performed by the injector of any cylinder, the injection command pulse having the determined pulse width is given to the injector drive circuit for driving the injector for that cylinder, and fuel injection is performed. During steady state operation of the engine, when it is determined at step S01 that flag F1 is not 0, subsequently, at step S07, it is determined that flag F2 is not 0, so each time the crank angle signal interrupt process of FIG. 4 is executed, the steady state injection process of step S11 is immediately executed.

When the algorithm shown in FIG. 4 is used, the starting state injection control means is configured by steps S01 through S05, and the steady state injection control means is configured by step S01, step S06, and steps S07 through S10.

Figure 2:
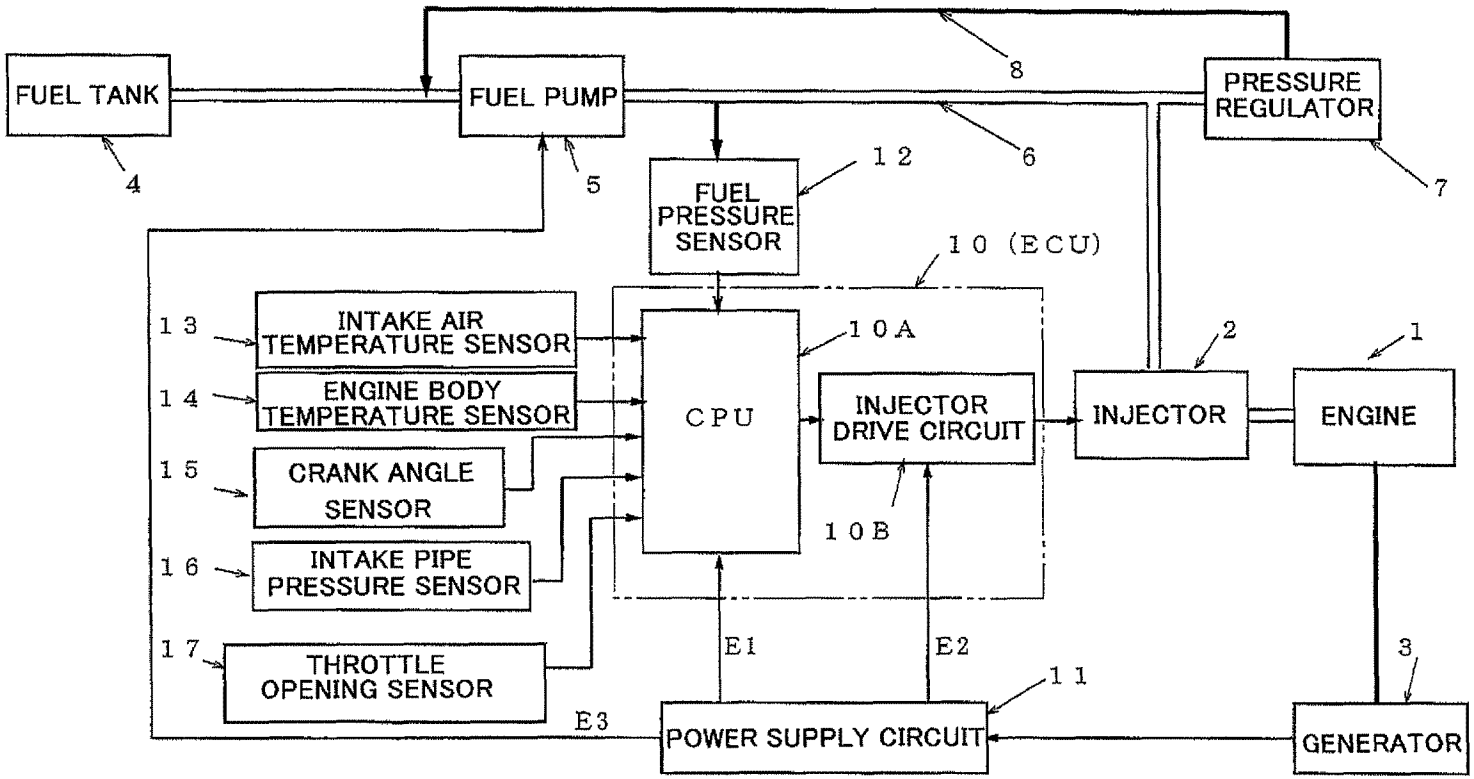
FIG. 2 is a block diagram schematically showing the configuration of another embodiment of the fuel injection control system of the present invention.

With the embodiment noted above, the water temperature sensor 14 was used as the temperature sensor for detecting the temperature in which the engine body temperature is reflected, but as shown in FIG. 2, instead of the water temperature sensor, it is also possible to provide an engine body temperature sensor 14' for detecting the temperature of the engine body, and to control the start time and steady state operation time fuel injection according to the engine body temperature. When adopting such a configuration, the crank angle signal interrupt process executed by the CPU 10A is the same as the interrupt process of FIG. 4, except for the point that body temperature was used instead of water temperature with steps S02 and S03.

Figure 5:
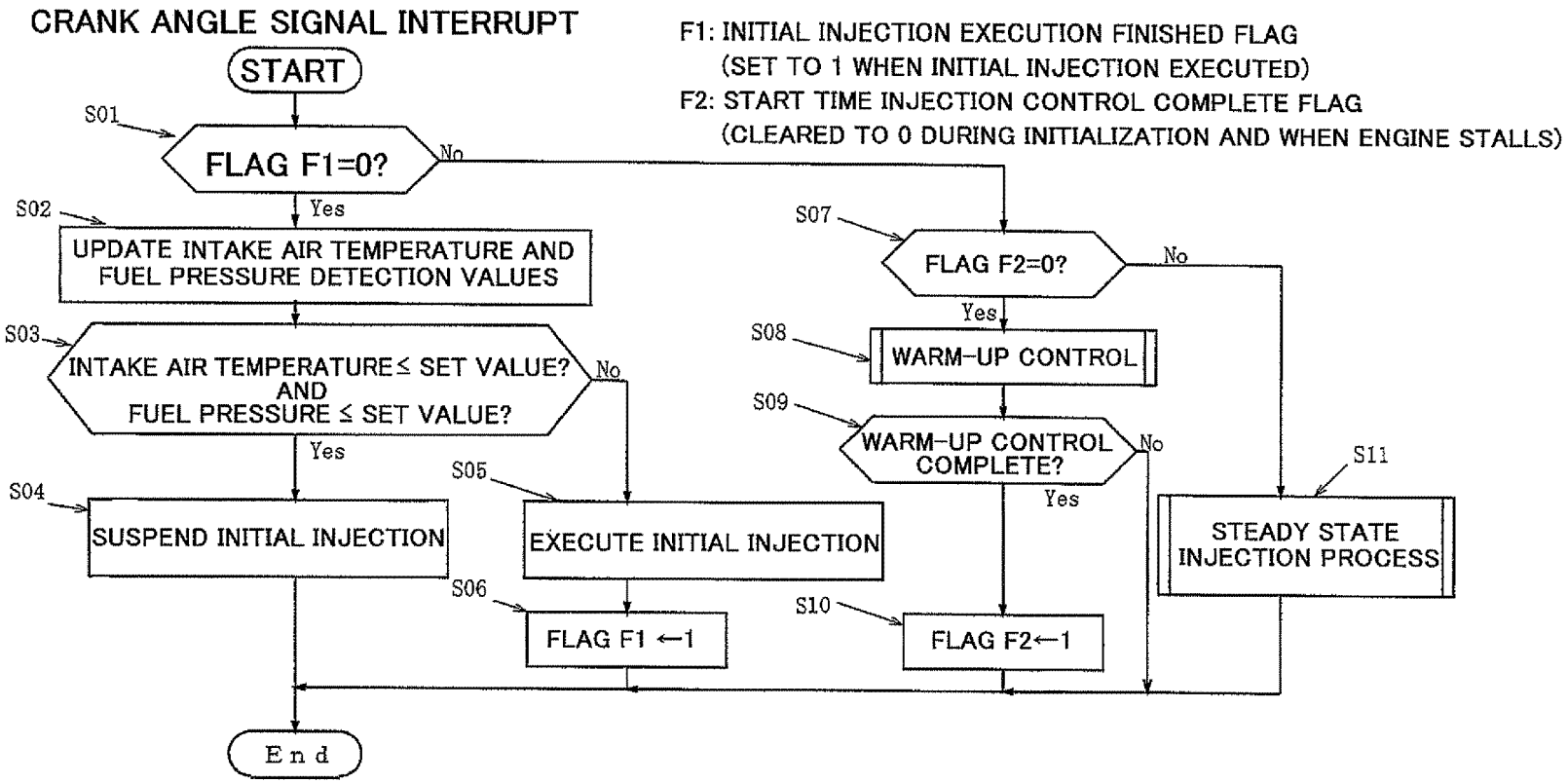
FIG. 5 is a flow chart showing another algorithm of a process executed by the CPU of the ECU in the embodiment of FIG. 1.

Also, in the embodiment noted above, the water temperature sensor or the engine body temperature sensor is provided as the temperature sensor for which the temperature of the engine body is reflected, and execution of the initial fuel injection is suspended when the initial injection suspension conditions; i.e., during engine starting, the temperature detected by the temperature sensors being the set temperature or less, and the fuel pressure being a set pressure or less, are established. However, it is also possible to use the intake air temperature sensor 13 as the temperature sensor in which the ambient temperature is reflected, and to have the initial fuel injection suspended when the initial injection suspension conditions; i.e., the temperature detected by the temperature sensor being the set temperature or less, and the fuel pressure being the set pressure or less, are established. The flow chart showing the algorithm of the crank angle signal interrupt process executed by the CPU in this case is shown in FIG. 5. The crank angle signal interrupt process shown in FIG. 5 is the same as the crank angle signal interrupt process shown in FIG. 4 except that at step S02, the detection values of the intake air temperature and the fuel pressure are updated, and at step S03, a determination is made of whether the initial injection suspension conditions of, the intake air temperature is the set temperature or less, and the fuel pressure is the set pressure or less, are established.

Figure 3:
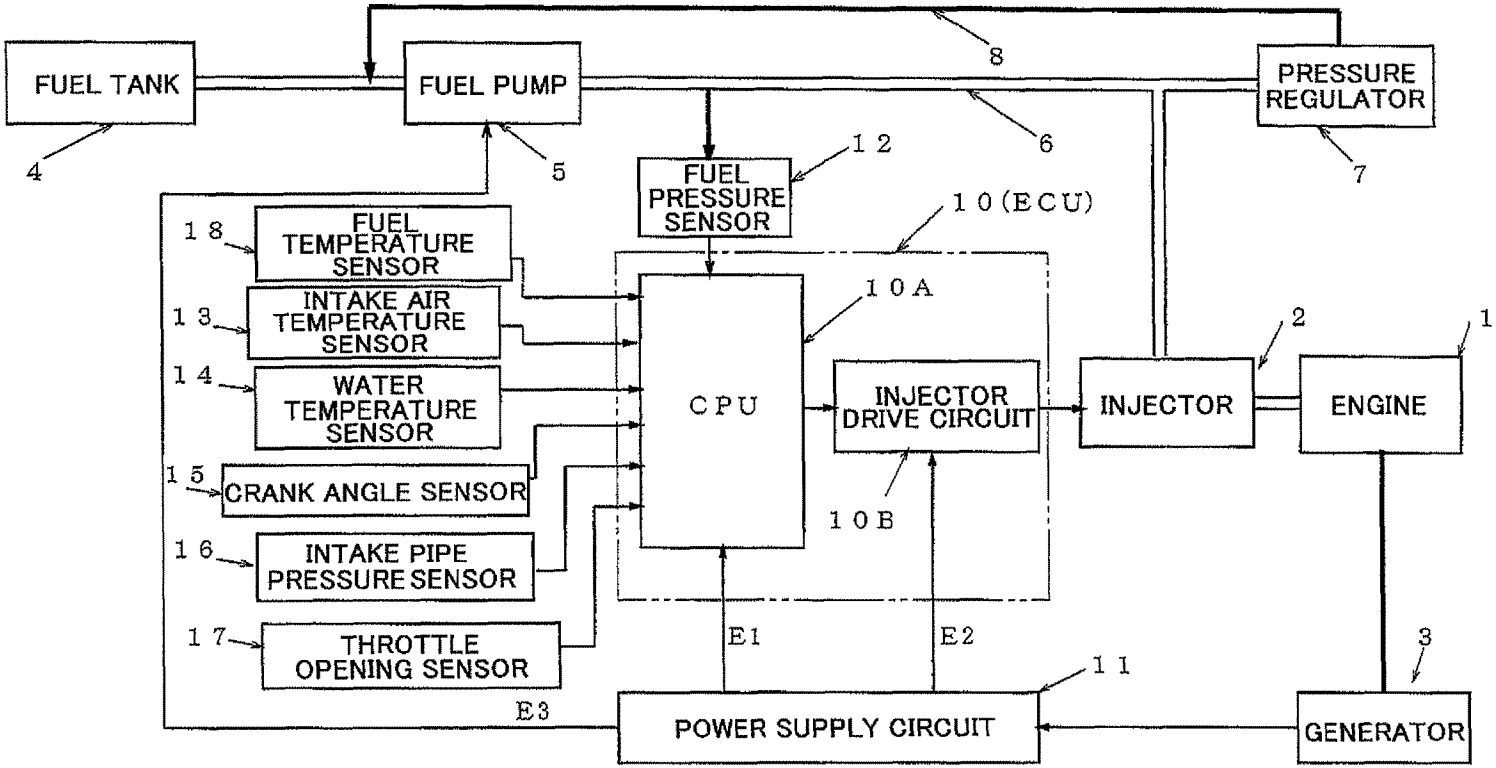
FIG. 3 is a block diagram schematically showing the configuration of yet another embodiment of the fuel injection control system of the present invention.
Figure 6:
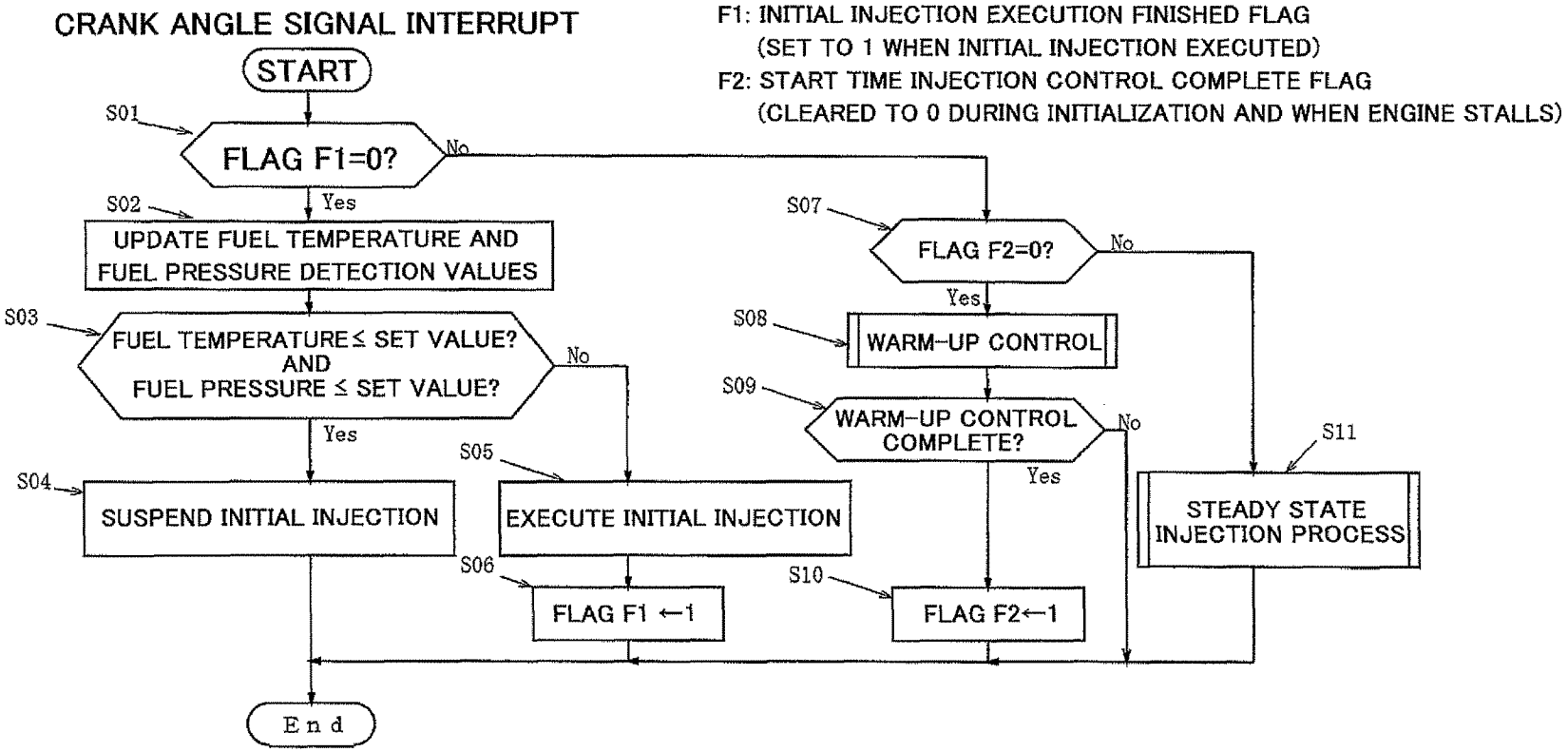
FIG. 6 is a flow chart showing an algorithm of a process executed by the CPU of the ECU in the embodiment of FIG. 3.

As shown in FIG. 3, as the temperature sensor for detecting the temperature in which the ambient temperature is reflected, a fuel temperature sensor 18 for detecting the temperature in which the temperature of the fuel supplied to the injector is provided, and with the conditions of, the fuel temperature detected by this fuel temperature sensor being the set temperature or less, and the fuel pressure being the set pressure or less, as the initial injection hold condition, it is also possible to suspend execution of the initial fuel injection when this initial injection suspend condition is established when the engine is started. The flow chart showing the algorithm of the crank angle signal interrupt process executed when a configuration is adopted in this way is shown in FIG. 6. The crank angle signal interrupt process shown in FIG. 6 is the same as the crank angle signal interrupt process shown in FIG. 4 except that at step S02, the fuel temperature detection value and the fuel pressure detection value are updated, and at step S03, a determination is made of whether the initial injection suspension conditions; i.e., the fuel temperature being the set temperature or less, and the fuel pressure being the set pressure or less, are established.

With the embodiment noted above, as shown in FIG. 8 (A), the crank angle signal generator was configured by a rotor configured by providing a plurality of reluctors at the outer periphery of the flywheel 20 attached to the crankshaft la of the engine, the electromagnetic pickup 21 for outputting pulses of different polarities respectively detecting the front end side edge and back end side edge in the rotation direction of each reluctor of this rotor, and the waveform shaping circuit 15 for obtaining the crank angle signals by performing waveform shaping of the output pulses of this electromagnetic pickup. However, as shown in FIG. 8 (B), it is also possible to configure the crank angle signal generator using a rotor provided with just one reluctor r1 at the outer periphery of the flywheel 20 attached to the crankshaft la of the engine, the electromagnetic pickup 21 for generating pulses of different polarities when the front end side edge and the back end side edge of the rotation direction of this rotor reluctor r1 is detected, and the waveform shaping circuit 15 for obtaining the crank angle signal by doing waveform shaping of the output pulses of this electromagnetic pickup.

When using a crank angle signal generator like that shown in FIG. 8 (B), while the crankshaft is making one rotation, a crank angle signal is generated only once, so when the engine has a plurality of cylinders, a timer is provided for starting a clocking operation when the crank angle signal is generated, and a timer measurement time calculation means is provided for calculating, as the timer measurement time, the time for which it is necessary to have the timer do measurement in order to detect the timing at which fuel injection is performed by the injector for each cylinder, and by having the timer measure the timer measurement time calculated by this calculation means, it is possible to find the injection timing for which fuel injection is performed by the injector for each cylinder.

When providing the injector so as to inject fuel inside the intake pipe provided in common to a plurality of cylinders of the engine, or when there is only a single cylinder of the engine, the crank angle signal generator shown in FIG. 8 (B) can use as the injection timing the timing at which the crank angle signal is generated.

Figure 9:
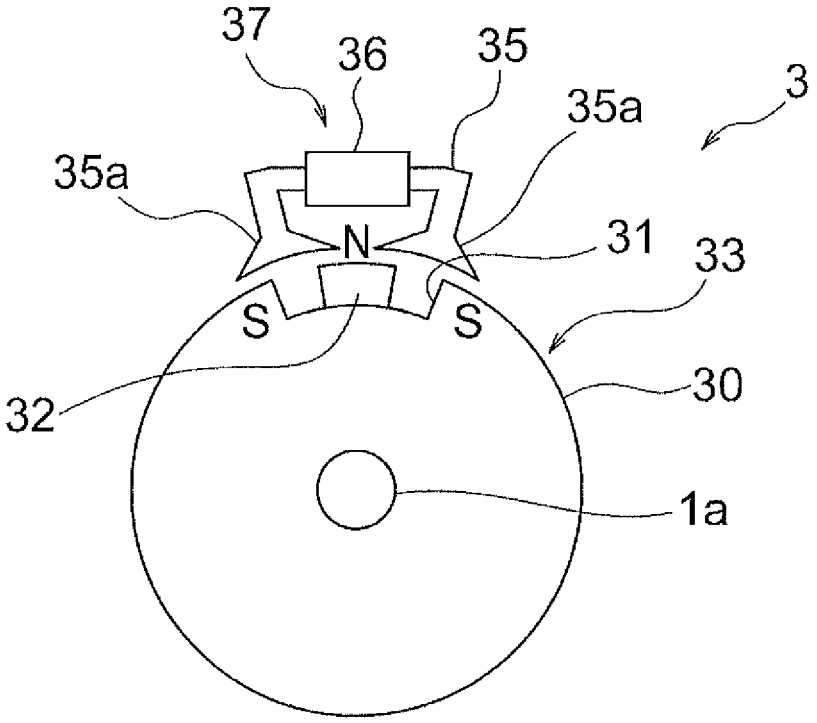
FIG. 9 is a front view typically showing a configuration example of a generator that can be used with the fuel injection control system of the present invention.

As shown in FIG. 9, it is also possible to use, as the generator 3, a known flywheel magnet for which a permanent magnet 32 is attached inside a recess 31 provided on the outer periphery of a flywheel 30 attached to the crankshaft la of the engine, the flywheel magnet comprising: a rotor 33 in which three rotor magnetic poles are formed on the outer periphery part of the flywheel from a magnetic pole on one side of the permanent magnet 32 (the N pole in the shown example) facing outward in the radial direction of the flywheel 30, and magnetic poles on the other sides of the permanent magnet 32 (the S poles in the shown example) led out on the outer peripheral part of the flywheel on both sides of the recess 31; and a stator 37 obtained by winding a magneto coil 36 on an iron core 35 that has magnetic pole parts 35*a*, 35*b* facing the outer periphery of the flywheel 30. When using this kind of generator, it is also possible to use as the crank angle signal the signal obtained by doing waveform shaping of the voltage outputted by the magneto coil 36 synchronously with the rotation of the crankshaft.

Figures 10A, 10B, 10C:
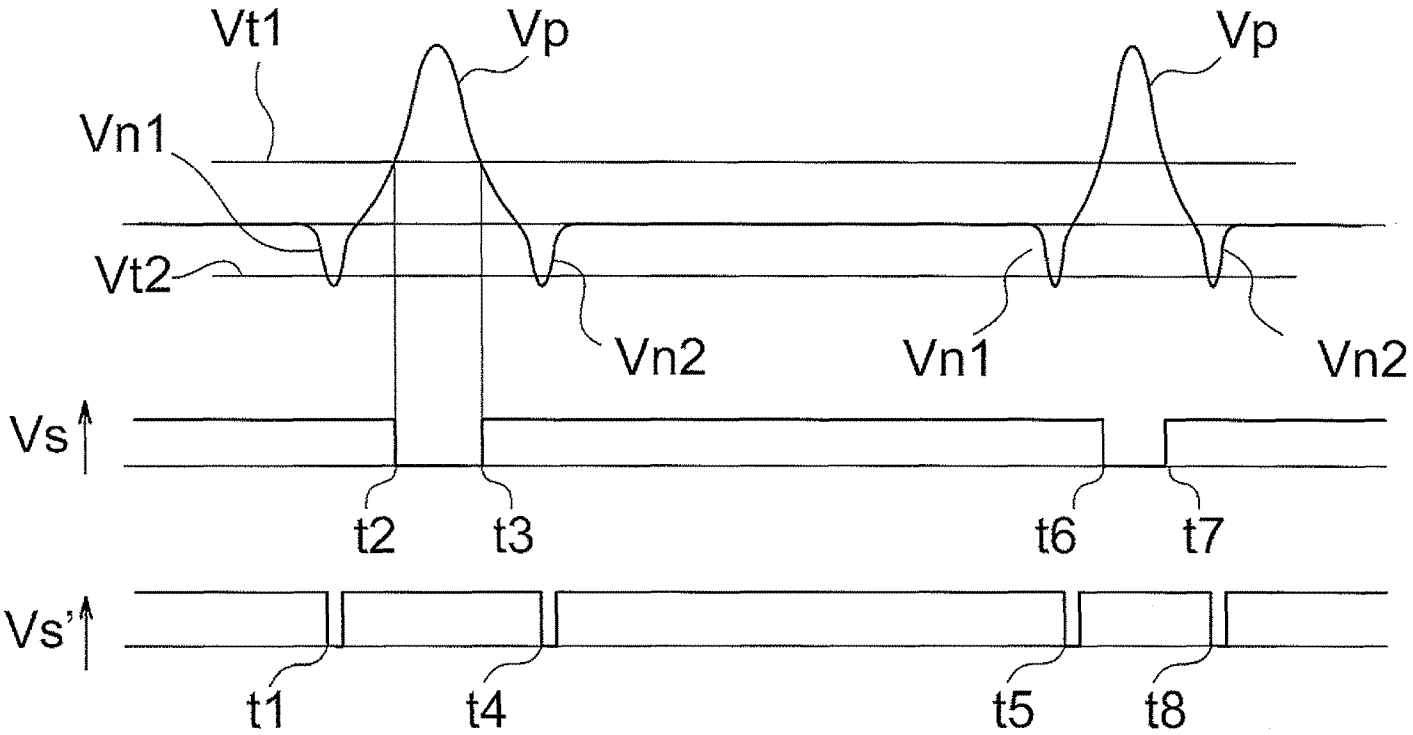
FIG. 10 (A) is a waveform chart showing the waveform of the output voltage obtained from the generator shown in FIG. 9, and (B) and (C) are waveform charts showing the waveform of crank angle signals that can be obtained from the output of the generator of FIG. 9.

As shown in FIG. 10 (A), along with rotation of the crankshaft, the generator shown in FIG. 9 generates AC voltage for which appear in sequence a first negative half wave voltage Vn1, a positive half wave voltage Vp for which the wave height value is higher than that of the first negative half wave voltage, and a second negative half wave voltage Vn2 having an equal wave height value to the voltage of the first negative half wave voltage. Also, depending on the winding direction of the magneto coil, an AC voltage is generated which has a waveform inverted from the waveform shown in FIG. 10 (A). In this case, the voltage Vp induced by the magneto coil 36 can obtain a signal Vs of a rectangular wave shape such as that shown in FIG. 10 (B) by being compared with a threshold value Vt1, and by comparing the voltages Vn1, Vn2 with a threshold value Vt2, it is possible to obtain a signal Vs' of the kind of rectangular wave shape shown in FIG. 10 (C). The rectangular wave signals Vs and Vs' are signals that have rises and falls at predetermined rotation angle positions of the crankshaft, and are signals including engine rotation information, so it is possible to use these signals as crank angle signals.

In the embodiment noted above, the starting state injection control means was configured so that execution of the fuel injection is suspended when, during engine starting, the temperature detected by the temperature sensor is a set temperature or less, and the fuel pressure detected by the fuel pressure sensor is a set pressure or less, and after the fuel pressure detected by the fuel pressure sensor is confirmed to have exceeded the set pressure, the first fuel injection is performed by the injector, and when the temperature detected by the temperature sensor during engine starting exceeds the set temperature, the first fuel injection is performed by the injector even in a state in which the fuel pressure detected by the fuel pressure sensor is the set pressure or less. However, it is also possible to configure the starting state injection control means so that in the process of starting the engine, execution of the fuel injection is suspended when the fuel pressure detected by the fuel pressure sensor is the set pressure or less, the temperature of the engine body or the ambient temperature not being used as control conditions, and the first fuel injection is performed by the injector after it is confirmed that the fuel pressure detected by the fuel pressure sensor is exceeded.

Several embodiments of the present invention have been described above, but the present invention is not limited by the configurations shown in the embodiments noted above. As shall be apparent, it is possible to make various modifications for each part provided that there is no departure from the technical concepts recited in the claims.

The invention claimed is:

1. A battery-less fuel injection system for an engine, the system supplying fuel to an engine started by a manually operated starting device, wherein the fuel injection system for an engine comprises:

an injector provided so as to supply fuel to the engine, an electrically powered fuel pump for supplying fuel to the injector, a fuel pressure sensor for detecting the pressure of the fuel supplied from the fuel pump to the injector, a temperature sensor for detecting the temperature in which the engine body temperature or the ambient temperature is reflected, and an ECU for controlling the injector so as to perform the necessary fuel injection to operate the engine;

the injector, the fuel pump, and the ECU being provided so as to be activated by a generator driven by the engine;

the ECU comprising starting state injection control means for controlling the fuel injection performed by the injector when the engine is started, and steady-state injection control means for controlling fuel injection performed by the injector after starting of the engine is completed; and the starting state injection control means is configured so as to suspend execution of the fuel injection, when the temperature detected by the temperature sensor in the process of starting the engine is a set temperature or less, and the fuel pressure detected by the fuel pressure sensor in the process of starting the engine is a set pressure or less; and to have the injector perform the first fuel injection after it is confirmed that the fuel pressure detected by the fuel pressure sensor has exceeded the set pressure, and the starting state injection control means being also configured so as to have the injector perform the first fuel injection when the temperature detected by the temperature sensor in the process of starting the engine exceeds the set temperature, even when the fuel pressure detected by the fuel pressure sensor in the process of starting the engine is the set pressure or less.

2. A battery-less fuel injection system for an engine, the system supplying fuel to an engine started by a manually operated starting device, wherein the fuel infection system for an engine comprises:

an injector provided so as to supply fuel to the engine; an electrically powered fuel powered fuel pump for supplying fuel to the injector; a fuel pressure sensor for detecting the pressure of the fuel supplied from the fuel pump to the injector;

a crank angle sensor for generating a plurality of crank angle signals at set crank angle positions during one rotation of the engine crankshaft; and an ECU for controlling the injector so as to perform the necessary fuel injection to operate the engine, the injector, the fuel pump, and the ECU being provided so as to be activated by a generator driven by the engine;

the ECU comprising starting state injection control means for controlling the fuel injection performed by the injector when the engine is started, and steady-state injection control means for controlling fuel injection performed by the injector after starting of the engine is completed; the starting state injection control means being configured so as to suspend execution of the fuel injection, when the fuel pressure detected by the fuel pressure sensor in the process of starting the engine is a set pressure or less, and to have the injector perform the first fuel injection after it is confirmed that the fuel pressure detected by the fuel pressure sensor has exceeded the set pressure, the ECU being configured so as to perform a signal determining process for determining the rotation angle position at which each crank angle signal was generated, and to specify the regular fuel injection timing based on the generated crank angle signal for which the rotation angle position was determined said starting state injection control means being configured so as to have the injector perform the first fuel injection at the timing at which any crank angle signal is detected when the signal determining process is incomplete at the point it is confirmed that the fuel pressure has exceeded a set pressure, and said starting state injection control means being also configured so as to have the injector perform the first fuel injection at the regular fuel injection timing specified based on the crank angle signal when the signal determining process is completed at the point it is confirmed that the fuel pressure has exceeded a set pressure.

3. The battery-less fuel injection system for an engine of claim 1, said system comprising a crank angle sensor for generating a plurality of crank angle signals at set crank angle positions during one rotation of the engine crankshaft;

the ECU being configured so as to perform a signal determining process for determining a rotation angle position at which each crank angle signal was generated, and to specify the regular fuel injection timing based on the generated crank angle signal for which the rotation angle position was determined; and the starting state injection control means being configured so as to perform the first fuel injection at the timing at which any crank angle signal is detected when the signal determining process is incomplete at the point it is confirmed that the fuel pressure has exceeded a set pressure, and to perform the first fuel injection at the regular fuel injection timing specified based on the crank angle signal when the signal determining process is completed at the point it is confirmed that the fuel pressure has exceeded a set pressure.

4. The battery-less fuel injection system for an engine of claim 1, wherein the temperature sensor is provided so as to detect the temperature of coolant of the engine.

5. The battery-less fuel injection system for an engine of claim 1, wherein the temperature sensor is provided so as to detect the temperature of the engine body.

6. The battery-less fuel injection system for an engine of claim 1, wherein the temperature sensor is provided so as to detect the temperature of the air taken into the engine intake pipe.

7. The battery-less fuel injection system for an engine of claim 1, wherein the temperature sensor is provided so as to detect the temperature for which the temperature of the fuel supplied to the injector is reflected.

8. A fuel injection control method for controlling a battery-less fuel injection system for an engine for supplying fuel to an engine started by a manually operated starting device; wherein said system comprises an electrically powered fuel pump for supplying fuel to the injector, a fuel pressure sensor for detecting the pressure of the fuel supplied from the fuel pump to the injector, an ECU for controlling the injector, and a temperature sensor for detecting a temperature in which an engine body temperature or an ambient temperature is reflected, the injector, the fuel pump, and the ECU being activated using a generator driven by the engine;

the method including a start injection control process executed when the engine is started, the process comprises the steps of;

monitoring the temperature detected by the temperature sensor and the fuel pressure detected by the fuel pressure sensor suspending, when the temperature detected by the temperature sensor is a set temperature or less, execution of the fuel injection when the fuel pressure detected by the fuel pressure sensor is a set pressure or less until it is confirmed that said fuel pressure has exceeded the set pressure;

causing the injector to execute the fuel injection after it is confirmed that the fuel pressure detected by the fuel pressure sensor has exceeded the set pressure; and when the temperature detected by the temperature sensor exceeds the set temperature, causing the injector to execute the fuel injection even when the fuel pressure detected by the fuel pressure sensor is the set pressure or less.

* * * * *